US010503123B2

(12) United States Patent
Hasegawa

(10) Patent No.: US 10,503,123 B2
(45) Date of Patent: Dec. 10, 2019

(54) ANALOG ELECTRONIC TIMEPIECE AND HAND DRIVE CONTROL DEVICE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 772 days.

(21) Appl. No.: 15/204,611

(22) Filed: Jul. 7, 2016

(65) Prior Publication Data

US 2017/0075313 A1 Mar. 16, 2017

(30) Foreign Application Priority Data

Sep. 15, 2015 (JP) ..... 2015-181515

(51) Int. Cl.
*G04G 9/00* (2006.01)
*G04G 5/00* (2013.01)
*G04C 3/14* (2006.01)

(52) U.S. Cl.
CPC ..... *G04G 9/0005* (2013.01); *G04C 3/14* (2013.01); *G04G 5/00* (2013.01)

(58) Field of Classification Search
CPC ..... G05B 13/028; G05B 19/4183; G05B 19/4184; G05B 19/41845; G05B 19/4185; G05B 19/41865; G05B 19/41875; G05B 2219/32287; G05B 2219/35001; G05B 2219/37337; G05B 2219/37351; G05B 2219/37434; G05B 2219/45004; G05B 2219/45129; G05B 23/0221;
(Continued)

(56) References Cited

U.S. PATENT DOCUMENTS 5,016,231 A 5/1991 Kawaguchi et al.
5,375,018 A * 12/1994 Klausner ..... G04G 7/00 368/47

(Continued)

FOREIGN PATENT DOCUMENTS

| | | | |
|---|---|---|---|
| FR | 2671646 | A1 | 7/1992 |
| JP | 02138895 | A | 5/1990 |
| JP | 2005055449 | A | 3/2005 |

OTHER PUBLICATIONS

Japanese Office Action (and English translation thereof) dated Jun. 27, 2017, issued in counterpart Japanese Application No. 2015-181515.

(Continued)

*Primary Examiner* — Bickey Dhakal
*Assistant Examiner* — Zoheb S Imtiaz
(74) *Attorney, Agent, or Firm* — Holtz, Holtz & Volek PC

(57) ABSTRACT

An analog electronic timepiece, including: a hand which is provided to be rotatable; and a processor which makes the hand perform at least one of an acceleration operation and a deceleration operation as a speed change operation when the hand is made to perform a fast forward movement, the acceleration operation being an operation of gradually increasing a fast forward speed of the hand from a stopped state when the fast forward movement is started, and the deceleration operation being an operation of gradually decreasing the fast forward speed until the hand comes into the stopped state when the fast forward movement is ended.

16 Claims, 5 Drawing Sheets

(58) Field of Classification Search
CPC ..... G05B 23/0229; G05B 23/024; G05B 23/0264; G05B 23/0283; G05B 23/0286; G05B 23/0289; G05B 23/0291; G05B 23/0294; G05B 23/0297; G05B 2219/40115; G05B 19/042; G05B 17/02; G05B 19/02; G05B 2219/23446; G06K 9/6263; G06K 19/0723; G06N 3/02; G06N 5/046; G06N 7/005; G06N 20/00; H04L 1/0002
See application file for complete search history.

(56) References Cited

U.S. PATENT DOCUMENTS

2001/0028606 A1* 10/2001 Fujisawa ..... G04G 19/08 368/204
2004/0246821 A1* 12/2004 Fujisawa ..... G04G 19/08 368/204

OTHER PUBLICATIONS

Extended European Search Report (EESR) dated Mar. 9, 2017, issued in counterpart European Application No. 16179597.6.

* cited by examiner

ANALOG ELECTRONIC TIMEPIECE AND HAND DRIVE CONTROL DEVICE

BACKGROUND OF THE INVENTION

1. Field of the Invention

The present invention relates to an analog electronic timepiece which performs display by using hands and a hand drive control device.

2. Description of Related Art

There have been conventionally electronic timepieces which can perform various types of display according to the world clock function of displaying dates and times for various areas in the world, alarm notification function, stopwatch function, timer function, sensor measurement function and such like in addition to display of the current date and time. When the various types of display are performed by switching such functions in analog electronic timepieces which perform display by using hands, the analog electronic timepieces fast forward hands for moving the hands to respective corresponding initial positions and changing setting values or updating measurement values during display of the functions.

For example, Japanese Patent Application Laid Open Publication No. 2005-55449 which is a Japanese patent document discloses a technique capable of switching between a normal display mode and a power-saving mode for stopping hand movements in an electronic timepiece which includes a power generation section and a power supply section that has a capacitor for accumulating electric power supplied from the power generation section and supplies the electric power to other sections. In the technique, when the mode shifts to the power saving mode, display of a charging voltage of the capacitor is performed by fast forwarding based on a predetermined fast forward pulse. When the mode returns to the display mode, hands are fast forwarded to respective positions corresponding to the current time, thus allowing rapid return to the display of current time.

In addition, various techniques have been conventionally used in analog electronic timepieces for fast forwarding a hand to a desired position in the shortest possible time by adjusting a fast forward speed and a fast forward direction in consideration of the relationship between the number of steps of moving the hand for display and the rotation speed of a stepping motor rotating the hand.

However, there is a problem that simple fast forwarding of hands in the shortest time makes the fast forward operations uniform and does not expand the range of expression.

SUMMARY OF THE INVENTION

An object of the present invention is to provide an analog electronic timepiece and a hand drive control device which can expand the range of expression according to fast forward operations of hands.

In order to solve the above object, according to one aspect of the present invention, there is provided an analog electronic timepiece, including: a hand which is provided to be rotatable; and a processor which makes the hand perform at least one of an acceleration operation and a deceleration operation as a speed change operation when the hand is made to perform a fast forward movement, the acceleration operation being an operation of gradually increasing a fast forward speed of the hand from a stopped state when the fast forward movement is started, and the deceleration operation being an operation of gradually decreasing the fast forward speed until the hand comes into the stopped state when the fast forward movement is ended.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of the present invention will be described with reference to the drawings.

Figure 1:
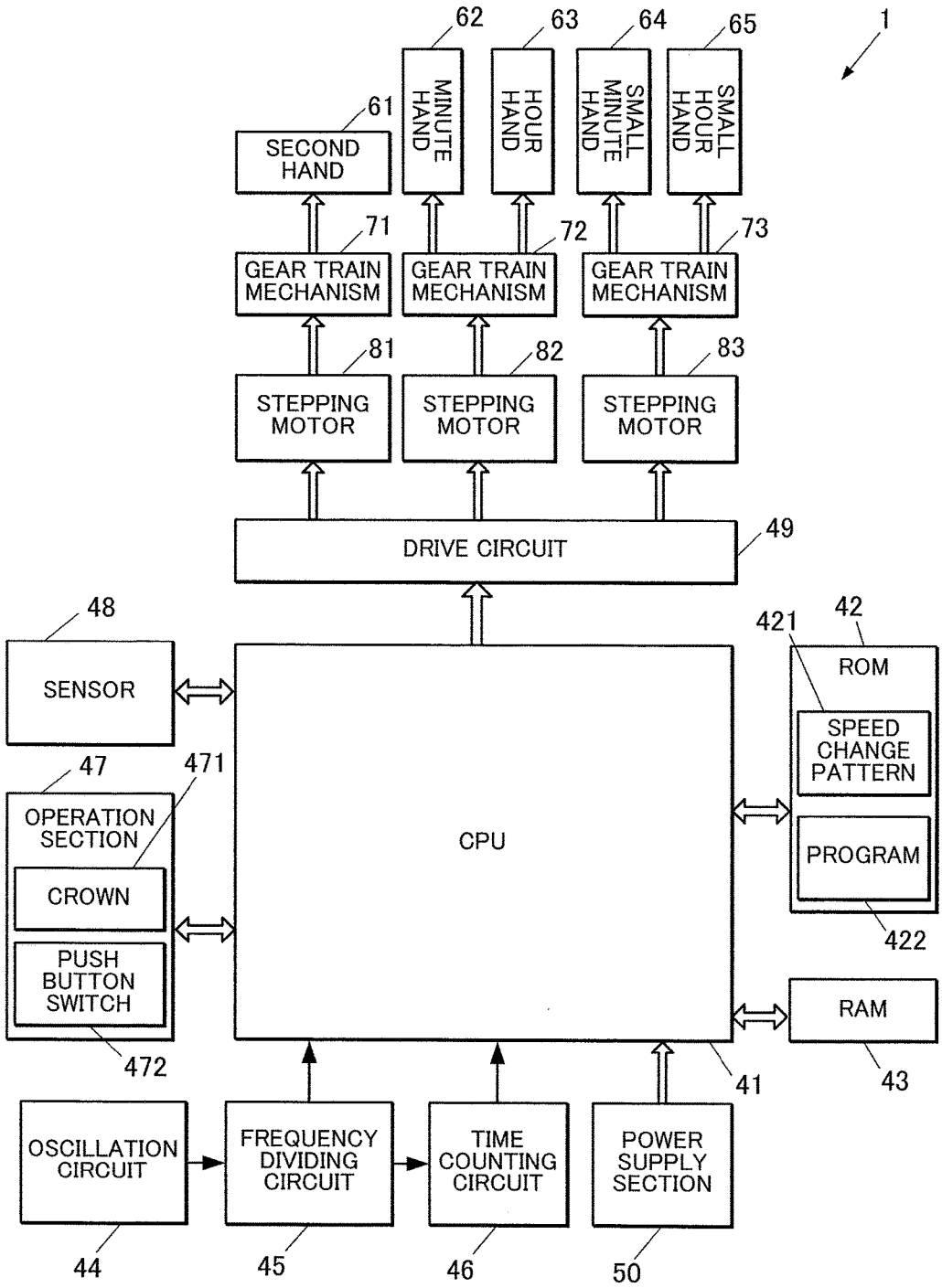
FIG. 1 is a block diagram showing a functional configuration of an electronic timepiece in an embodiment of the present invention.

FIG. 1 is a block diagram explaining a functional configuration of an analog electronic timepiece in the embodiment.

The analog electronic timepiece 1 is an electronic timepiece which displays time by operating hands, and includes a CPU 41 (Central Processing Unit) as a fast forward control section, a ROM 42 (Read Only Memory) as a speed change pattern storage section, a RAM 43 (Random Access Memory), an oscillation circuit 44, a frequency dividing circuit 45, a time counting circuit 46, an operation section 47, a sensor 48, a drive circuit 49, a power supply section 50, a second hand 61, a minute hand 62, an hour hand 63, a small minute hand 64, a small hour hand 65, gear train mechanisms 71 to 73, stepping motors 81 to 83 (hand driver, driver), and such like.

A part or all of the second hand 61, minute hand 62, hour hand 63, small minute hand 64 and small hour hand 65 are collectively referred to as hands 61 to 65, for example.

The CPU 41 and the stepping motors 81 to 83 form a hand drive control device. The hand drive control device can include the ROM 42, RAM 43 and the drive circuit 49.

The CPU 41 is a processor which performs various types of arithmetic processing and integrally controls the entire operation of the analog electronic timepiece 1. The CPU 41 controls hand operations according to display of date and time counted by the time counting circuit 46, measurement by the sensor 48, processing of measurement values and display of the measurement values and setting values in various function modes.

Various control programs executed by the CPU 41 and setting data are stored in the ROM 42. The programs include a program 422 according to operation control of hands 61 to 65 in the various function modes. The setting data includes a fast forward speed change pattern 421 for a case of fast forwarding the hands 61 to 65.

The RAM 43 provides a working memory space to the CPU 41, and temporary data is stored in the RAM 43. In the RAM 43, data indicating hand positions and display range information of display in the various function modes are stored.

The oscillation circuit 44 generates and outputs a predetermined frequency signal. The oscillation circuit 44 includes a crystal oscillator, for example.

The frequency dividing circuit 45 divides the predetermined frequency signal output from the oscillation circuit 44 into frequency signals used by the CPU 41 and the time counting circuit 46, and outputs the divided signals. The output frequency may be set to be changeable by a control signal from the CPU 41.

The time counting circuit 46 counts the current date and time by counting the signals input from the frequency dividing circuit 45 and adding the counted value to an initial value indicating predetermined date and time. The date and time counted by the time counting circuit 46 has an error (rate) according to accuracy of the oscillation circuit 44, the error being, for example, approximately 0.5 second per day. The date and time counted by the time counting circuit 46 can be corrected by a control signal from the CPU 41.

The operation section 47 receives an input operation from a user. The operation section 47 includes a crown 471 and one or a plurality of push button switch 472. When the crown 471 is pulled out, pushed back or rotated, or the push button switch 472 is pushed down, an electrical signal according to the type of the operation is output to the CPU 41.

The sensor 48 measures predetermined spatial physical quantity. Though not especially limited, the sensor 48 can measure temperature, humidity, atmospheric pressure, inclination from a horizontal plane, acceleration, magnetic field (geomagnetism) and such like. Conversion of temperature between Celsius and Fahrenheit, conversion of atmospheric pressure value into an altitude value and such like are executed separately by the CPU 41, for example.

The power supply section 50 supplies electric power according to operations of sections at a predetermined voltage. The power supply section 50 has a battery, and a solar panel and a secondary battery are used as the battery, for example. A button type dry cell which is detachable to be replaced may also be used as the battery. In a case where the power supply section 50 outputs a plurality of different voltages, a switching power supply or the like can be used for conversion into a predetermined voltage to allow the output of different voltages.

The drive circuit 49 outputs a drive pulse at a predetermined voltage to the stepping motors 81 to 83 in accordance with a control signal from the CPU 41. The drive circuit 49 can change the length (pulse width) and amplitude (peak voltage value) of drive pulse according to the state of analog electronic timepiece 1. When a control signal of simultaneously driving a plurality of hands is input, the drive circuit 49 can slightly shift the output timing of drive pulse in order to reduce the load.

The stepping motor 81 makes the second hand 61 perform a step operation via the gear train mechanism 71 which has a plurality of arranged gears. When the stepping motor 81 is driven once, the second hand 61 is rotated 6 degrees as one step. When the stepping motor 81 is driven 60 times, the second hand 61 makes one rotation on a dial plate which is provided to be nearly parallel to the rotation plane of the hands 61 to 64. Scales and marks (hour marks) for defining hand positions of the hands 61 to 63 are provided on the dial plate.

The stepping motor 82 rotates the minute hand 62 and the hour hand 63 via the gear train mechanism 72. The gear train mechanism 72 makes the minute hand 62 and the hour hand 63 rotate in conjunction with each other. The gear train mechanism 72 makes the minute hand 62 rotate 1 degree and makes the hour hand 63 rotate 1/12 degree per step. Accordingly, the minute hand 62 moves once every 10 seconds, and thus, the minute hand 62 makes one rotation on the dial plate in 60 minutes. Meanwhile, the hour hand 63 rotates 30 degrees on the dial plate. That is, the hour hand 63 makes one rotation on the dial plate by the movement of 4320 steps in 12 hours.

The stepping motor 83 rotates the small minute hand 64 and the small hour hand 65 via the gear train mechanism 73. The gear train mechanism 73 rotates the small minute hand 64 and the small hour hand 65 in conjunction with each other. When the stepping motor 83 is driven once, the small minute hand 64 rotates 6 degrees (predetermined angle), and the small hour hand 65 rotates ½ degree. That is, the small minute hand 64 makes one rotation on the dial plate when the stepping motor 83 is driven 60 times. The small hour hand 65 makes one rotation on the dial plate when the stepping motor 83 is driven 720 times. The small minute hand 64 and the small hour hand 65 rotate on a part of the dial plate with respect to a rotation axis different from the rotation axis of hands 61 to 63. Here, for example, the small minute hand 64 and the small hour hand 65 have lengths which are half or less of the lengths of minute hand 62 and the hour hand 63, respectively, and the small minute hand 64 and the small hour hand 65 rotate between the rotation axis of minute hand 62 and one of the marks on the dial plate indicated by the minute hand 62. That is, when the small minute hand 64 rotates 6 degrees, the movement distance of the tip of the small minute hand 64 is approximately twice or three times the movement distance of the tip of the minute hand 62 when the minute hand 62 rotates 1 degree. The movement distance of the tip of the small minute hand 64 is also the half or less the movement distance of the tip of the second hand 61 when the second hand 61 rotates 6 degrees.

Though not especially limited, the hands 61 to 65 can be rotated and fast forwarded both in the forward direction (clockwise direction) and in the backward direction at a maximum of 200 pps (pulse per second).

The hands 61 to 63 are normally used for displaying local time (home time) at the current position. The second hand 61 is also used for various operations such as setting of current position and world clock position and display of seconds in the stopwatch function.

The small minute hand 64 and the small hour hand 65 are used for display according to various functions. For example, when the world clock function is executed, the small minute hand 64 and the small hour hand 65 are used for displaying the local time at the set world clock position. In the stopwatch function, the small minute hand 64 and the small hour hand 65 are used for displaying the elapsed time. In the sensor measurement function, the small minute hand 64 and the small hour hand 65 are used for displaying numerical values and such like based on measurement values by a predetermined sensor. In a case where the range of numerical values according to sensor measurement is different from the range of time display of normal world clock, marks according to the display of numerical values based on the measurement may be separately provided in the rotation part (small window) of the small minute hand 64 and the small hour hand 65 on the dial plate.

Next, fast forward operation of hands 61 to 65 in the analog electronic timepiece 1 in the embodiment will be described.

The analog electronic timepiece 1 in the embodiment performs fast forward operation of a part or all of the hands 61 to 65 when switching the function mode, switching measurement values or setting values and performing initialization.

Figure 2:
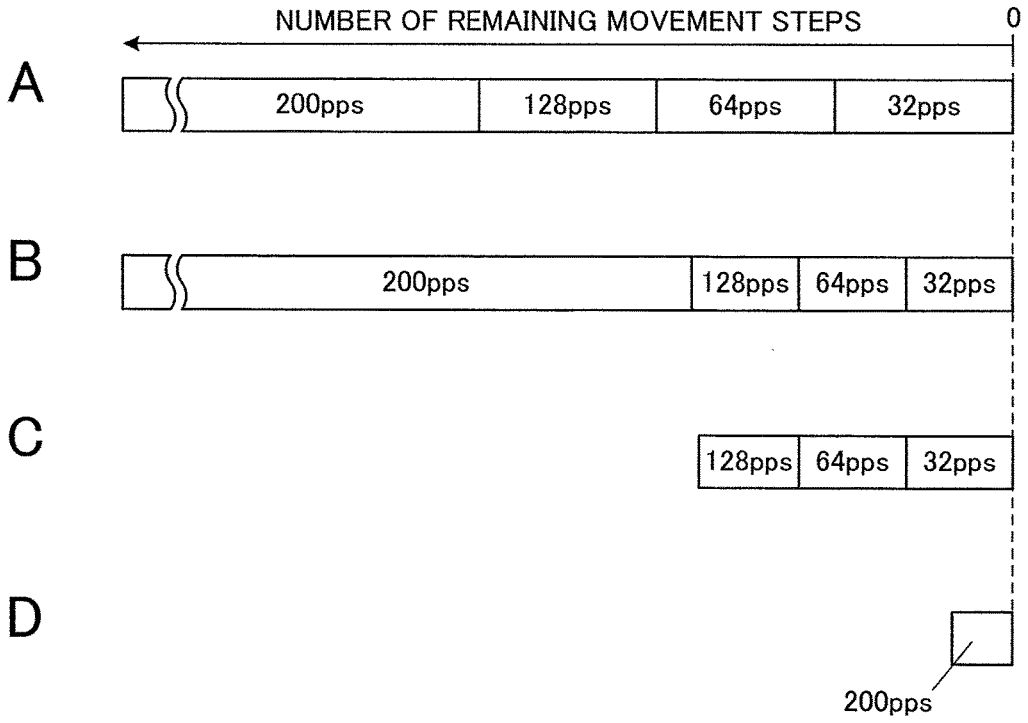
FIG. 2 is a view explaining an example of fast forward speed setting patterns.

FIG. 2 is a view explaining an example of setting patterns of fast forward speed.

In the analog electronic timepiece 1 of the embodiment, deceleration operation (speed change operation) of gradually decreasing (decelerating) the fast forward speed can be performed before end of the fast forwarding in a case of fast forwarding one of the hands 61, 62 and 64 (hereinafter, simply referred to as the hand) to a setting position (destination) (in a case of fast forwarding the hand 62 or 64, the hand 63 or 65 is fast forwarded in conjunction with the hand 62 or 64, respectively). Here, the deceleration operation is performed in a stepwise manner between a plurality of speeds (movement speeds). A plurality of types of patterns (speed change patterns) according to such deceleration are stored in advance as speed change patterns 421 in the ROM 42, each of the speed change patterns associating a plurality of speed change timings with respective movement speeds after the speed change.

In a pattern A shown in FIG. 2, the fast forward operation is started at the fast forward speed of 200 pps, and the fast forward speed is decelerated to 128 pps (movement speed after the speed change timing) at the time (speed change timing) when the number of remaining movement steps is a predetermined number (speed change start movement amount). The fast forward speed is further decelerated to 64 pps and 32 pps for respective predetermined steps. The fast forwarding is stopped (shift to stopped state) when the number of movement steps reaches a target movement amount (speed change end movement amount) which is a movement amount from the initial hand position to the target position, and the hand reaches the target position. The change timings of fast forward speed (speed change timings) according to the deceleration can be changed (delayed) with respect to the number of remaining movement steps as in a pattern B shown in FIG. 2.

In a case where the measurement interval by the sensor 48 is determined in advance, the hand which is the target of fast forwarding needs to reach the target position according to the display of previous measurement value prior to the start of display operation according to the next measurement (or prior to the start of next measurement) and display the measurement result for more than the minimum display time. Since the deceleration operation of fast forward speed increases the time required for the fast forward operation, it can be difficult to display the measurement result for more than the minimum display time if the deceleration operation is performed uniformly. Thus, in the analog electronic timepiece 1 in the embodiment, the deceleration pattern is selected according to the measurement interval of the sensor 48 and the movement time of the hand in a case of using each of the deceleration patterns.

As shown in a pattern C in FIG. 2, in a case where the number of movement steps is smaller than the number of remaining movement steps at the start timing of deceleration, it is possible to set the fast forward speed after the start of deceleration in the deceleration pattern to be the initial speed and decelerate the speed in accordance with only a low speed part of the deceleration pattern.

As shown in a pattern D in FIG. 2, in a case where the number of steps for fast forward operation is initially smaller than a predetermined lower limit value and the effect of deceleration cannot be obtained sufficiently, the deceleration operation (speed change operation) may not be performed as in the conventional timepieces, that is, the hand may be fast forwarded at a fixed speed without deceleration.

Here, if the fast forward speed is excessively low, the hand operation is not visually smooth but discrete, which is not desirable for visual effect. If there is a period having a very low fast forward speed compared to the fastest fast forward speed (for example, 1/10 or less the fastest speed), the required time for the hand to reach the target position is lengthened unnecessarily, which provides a stress to a user. Here, the fast forward speed is set within a range of making the fast forward movement of hand look smooth to a user by setting the minimum value of the fast forward speed to be 32 pps, for example.

It is preferable that the number of movement steps for each step of movement speed is set so that the movement time at the movement speed in each step is within a predetermined upper limit time since the speed change will not be visually smooth if the movement time at the fast forward speed in each step is longer (for example, 0.5 to 1.0 seconds or more), that is, if the number of movement steps excessively increases. The number of movement steps at a movement speed in each step does not need to be the same and may be appropriately set in consideration of expressive effect and such like.

Figure 3:
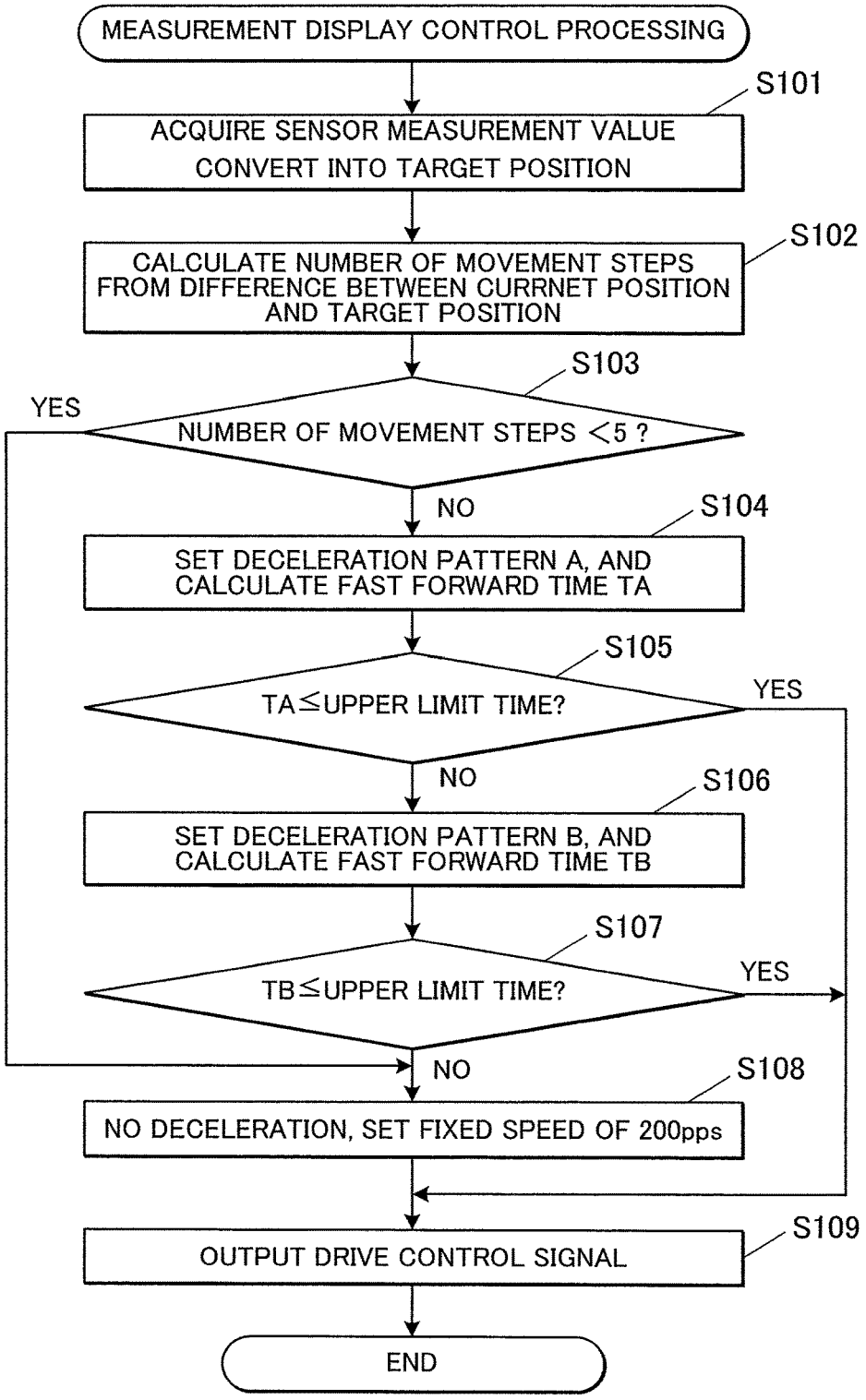
FIG. 3 is a flowchart showing a control procedure of measurement display control processing executed by an analog electronic timepiece in a first embodiment.

FIG. 3 is a flowchart showing a control procedure by the CPU 41 of measurement display control processing executed by the analog electronic timepiece 1 in the embodiment.

The measurement display control processing is started each time measurement is performed by the sensor 48 at a predetermined time interval in a case where an instruction of measuring predetermined physical quantity is obtained according to a predetermined input operation to the operation section 47 by the user.

When the measurement display control processing is started, the CPU 41 obtains the measurement value by the sensor 48 and calculates the position (hand position) according to the measurement value of each of the small minute hand 64 and the small hour hand 65 as a target position (step S101). The CPU 41 obtains the number of movement steps (target movement amount) by calculating the difference between the calculated target position and the current position (step S102).

The CPU 41 determines whether to perform speed change operation. The CPU 41 determines whether the number of movement steps is less than a predetermined lower limit number of steps, here, 5 steps (step S103). If it is determined that the number of movement steps is less than 5 steps (step S103: YES), the processing of CPU 41 proceeds to step S108. If it is not determined that the number of movement steps is less than 5 steps (step S103: NO), the CPU 41 sets a deceleration pattern A as the hand operation at the time of fast forwarding, and calculates a required time TA of the fast forwarding when the fast forwarding is performed in the deceleration pattern A (step S104).

The CPU 41 determines whether or not the required time TA is equal to or less than the upper limit time of fast forwarding (upper limit fast forward time) for displaying the measurement result for the minimum display time or more (step S105). That is, the upper limit time of fast forwarding is a value obtained by subtracting the minimum display time from the measurement interval (a time required for the measurement display control processing and such like may be further subtracted as needed). If it is determined that the required time TA is equal to or less than the upper limit time of fast forwarding (step S105: YES), the processing of CPU 41 proceeds to step S109.

If it is not determined that the required time TA is equal to or less than the upper limit time of fast forwarding (step S105: NO), the CPU 41 sets a deceleration pattern B as the hand operation of fast forwarding, and calculates required time TB of fast forwarding in the deceleration pattern B (step S106). The CPU 41 determines whether or not the required time TB is equal to or less than the upper limit time of fast forwarding (step S107). If it is determined that the required time TB is equal to or less than the upper limit time of fast forwarding (step S107: YES), the processing of CPU 41 proceeds to step S109. If it is not determined that the required time TB is equal or less than the upper limit time of fast forwarding (step S107: NO), the processing of CPU 41 proceeds to step S108.

When the processing of steps S103 and S107 proceeds to the processing of step S108, the CPU 41 determines not to perform deceleration in the fast forwarding, and sets the fast forwarding at the fixed speed of 200 pps (step S108). Then, the processing of CPU 41 proceeds to step S109.

When the processing of steps S105, S107 and S108 proceeds to step S109, the CPU 41 outputs a drive control signal according to fast forwarding of the small minute hand 64 and the small hour hand 65 to the drive circuit 49 (step S109). The CPU 41 ends the measurement display control processing.

Modification Example

Figure 4:
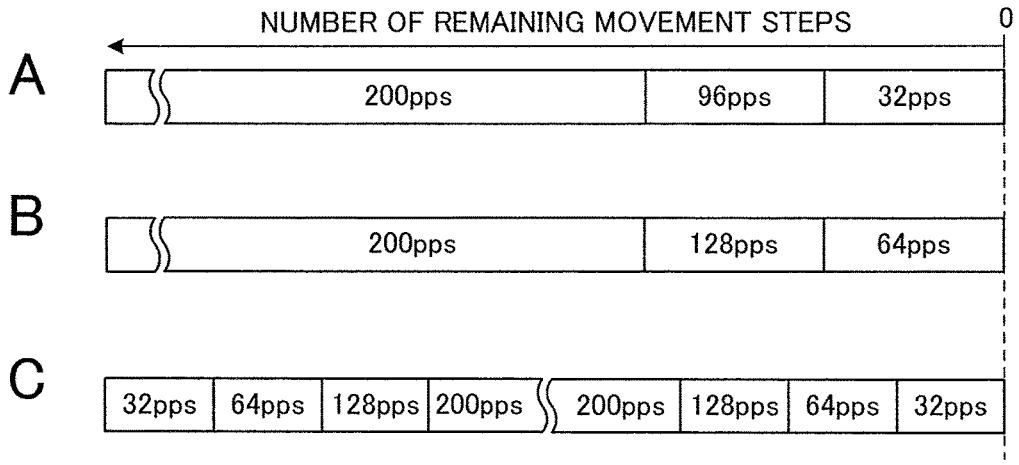
FIG. 4 is a view showing a modification example of fast forward speed setting patterns.

FIG. 4 is a view showing a modification example of setting patterns of fast forward speed.

As shown in a pattern A in FIG. 4, the speed step at the time of deceleration may be different from the speed step in the patterns A and B in FIG. 2 having deceleration, or may have a different number of steps. Here, the fast forwarding is ended by the two steps of decelerations by setting the period of fast forward speed of 96 pps instead of the movement operation at the fast forward speeds of 128 pps and 64 pps. However, since a large change in fast forward speed possibly makes the operation unnatural, it is desirable that the change in fast forward speed is set within a range of an upper limit change amount which is appropriately determined.

Similarly, as shown in a pattern B in FIG. 4, the final fast forward speed may not be 32 pps. Here, the fast forwarding is ended at the fast forward speed of 64 pps.

As shown in a pattern C in FIG. 2, even in a case where the fast forward required time is shorter than the deceleration time, the number of speed steps during the deceleration and the lowest value of fast forward speed may be changed instead of changing the initial speed of fast forwarding.

As shown in a pattern C in FIG. 4, as the speed change operation at the time of fast forwarding, the control may be made to perform the acceleration operation of gradually increasing the fast forward speed at the start of fast forwarding, not only perform the deceleration operation at the end of fast forwarding. Here, the fast forwarding is started at the fast forward speed of 32 pps, and the fast forward speed changes to 64 pps, 128 pps and 200 pps. Alternatively, only the acceleration at the start of fast forwarding may be performed without performing deceleration before the end of fast forwarding.

As described above, the analog electronic timepiece 1 in the first embodiment includes hands 61 to 65 which are provided to be rotatable and a CPU 41 as a fast forward control section which makes the hands 61 to 65 perform at least one of an acceleration operation and a deceleration operation as a speed change operation when the CPU 41 makes the hands 61 to 65 perform a fast forward movement, the acceleration operation being an operation of gradually increasing the fast forward speed of each of the hands 61 to 65 from the stopped state at the start of fast forward movement, and the deceleration operation being an operation of gradually decreasing the fast forward speed until each of the hands 61 to 65 comes into the stopped state at the end of the fast forward movement.

In such way, by not only moving and stopping the hands at a constant speed, but also changing the movement speeds of hands 61 to 65 during the movement, it is possible to broaden the range of expression according to the fast forward operations of the hands 61 to 65 in the analog electronic timepiece 1. Thus, necessary information can be indicated sensuously without boring the user, rather entertaining the user.

In a case where the number of movement steps of each of the hands 61 to 65 is determined for the fast forward movement, the speed change start movement amount and the speed change end movement amount in the fast forward movement for the number of movement steps are set on the basis of the number of movement steps, the speed change start movement amount being a movement amount of the hand at a timing when the speed change operation is started, and the speed change end movement amount being a movement amount of the hand at a timing when the speed change operation is ended. Thus, it is possible to determine, in advance, the number of steps required for the acceleration when performing the acceleration operation and/or the timing of starting the deceleration when performing the deceleration operation, appropriately set the time required for the speed change operation and the trend of deceleration, and perform the fast forward operation of each of the hands 61 to 65 in the analog electronic timepiece 1 more naturally.

In the speed change operation, the CPU 41 changes the fast forward speed in a stepwise manner between a predetermined number of steps of two or more movement speeds, here, 4 steps from 200 pps to 128 pps, 64 pps and 32 pps. Thus, even in a case where the computing power is limited as in the CPU 41 of the analog electronic timepiece 1, the hand movement speed can be changed effortlessly and easily.

In a case where the fast forward movement is performed at a predetermined interval, the CPU 41 sets the predetermined number of steps according to fast forward speed and the predetermined number of steps of movement speeds so as to end the fast forward movement within the fast forward upper limit time, which is determined to be less than the predetermined interval. That is, when the fast forward operation of hand is periodically performed at a constant interval, the speed change setting according to the fast forward operation is performed so as to end the fast forwarding of each of the hands and let the user know the instruction contents. Thus, the fast forward operation can be changed variously while surely indicating the display contents to the user.

The analog electronic timepiece 1 also includes the ROM 42 in which a plurality of types of speed change patterns is stored as speed change patterns 421, each of the speed change patterns associating a plurality of speed change timings with the respective movement speeds after the speed change timings in the speed change operation. On the basis of the required time of the fast forward movement including the speed change operation by each of the plurality of types of speed change patterns and the upper limit time of the fast forwarding, the CPU 41 selects one of the speed change patterns which can perform both of the speed change operation and the contents display appropriately within the upper limit time, and makes each of the hands 61 to 65 perform the fast forward movement according to the selected speed change pattern. Thus, it is possible to select an appropriate speed change pattern accurately by easy processing and perform the speed change operation while indicating necessary information to the user.

In a case where the required time of fast forward movement according to the speed change pattern is shorter than the time required for the speed change operation, the CPU 41 performs an operation for an amount of the required time, the operation being a low speed part of the speed change operation according to the speed change pattern. That is, by ending the fast forward operation during the acceleration operation or starting the fast forward operation during the deceleration operation, it is possible to make the hands 61 to 65 indicate necessary information while performing the speed change operation. In such way, it is possible to perform various expressions and make the fast forward operation expressive by easily and widely applying the speed change operation using preset speed change patterns to the fast forward operation of hands 61 to 65.

The analog electronic timepiece 1 also includes a sensor 48 which measures predetermined physical quantity such as air pressure value. The CPU 41 obtains the measurement result by the sensor 48 at a predetermined interval and determines the fast forward destination of each of the hands 61 to 65 on the basis of the obtained measurement result.

In such way, by applying the present invention to a case where display is performed according to the measurement result by performing sensor measurement at a predetermined interval, it is possible to let the user surely know the measurement result by appropriately displaying the results and variously changing the expression of fast forwarding according to the display.

The CPU 41 determines whether to perform the speed change operation according to the target movement amount. For example, in a case where a hand is moved a short distance which does not have a sufficient number of movement steps to obtain the effect according to the speed change operation, the hand should be moved rapidly without an effort to make the movement expressive in some cases. Thus, the CPU 41 can perform a preferable fast forward operation by appropriately comparing the effect of deceleration operation with the delay of fast forwarding due to the deceleration operation.

The analog electronic timepiece 1 further includes stepping motors 81 to 83 which make the hands 61, 62 and 64 perform a step operation by 1 or 6 degree, and the lowest value of a predetermined number of steps of movement speeds which are set in the speed change operation is determined on the basis of at least one of the angle of the step operation and the length of each hand. Thus, the fast forwarding can be accelerated and decelerated so as not to provide a feeling of strangeness to the user with respect to the fast forward operation by setting the fast forward speed within the range of making the hand operation look smooth.

The hand drive control device in the embodiment includes stepping motors 81 to 83 which rotate the hands 61 to 65, and the CPU 41 which, when controlling the stepping motors 81 to 83 to perform fast forward movement of the hands 61 to 65, controls the stepping motors 81 to 83 to perform at least one of an acceleration operation and a deceleration as the speed change operation, the acceleration operation being an operation of gradually increasing the fast forward speed of each of the hands 61 to 65 from the stopped state at the start of fast forward movement, and the deceleration operation being an operation of gradually decreasing the fast forward speed until each of the hands 61 to 65 comes into the stopped state at the end of the fast forward movement.

Since the CPU 41 drives the stepping motors 81 to 83 so as to perform the speed change operation of each of the hands at the time of fast forward operation of the hand, the range of expression according to the hand fast forward operation can be broaden by using the hand drive control device. Thus, necessary information can be indicated sensuously without boring the user, rather entertaining the user.

Second Embodiment

Next, an analog electronic timepiece in a second embodiment will be described.

Since the analog electronic timepiece 1 in the second embodiment includes the same components as those of the analog electronic timepiece 1 in the first embodiment, same reference numeral are used for the same components.

Among the components, in the analog electronic timepiece 1 in the second embodiment, the gear train mechanism 73 rotates the small minute hand 64 by 2 degrees each time the stepping motor 83 is driven once, and the small hour hand 65 is rotated ⅙ degree in accordance with the rotation. Accordingly, the small minute hand 64 and the small hour hand. 65 are moved once every 20 seconds when time and a period are displayed in the world clock function and the stopwatch function.

Next, a fast forward operation of a hand by the analog electronic timepiece 1 in the second embodiment will be described.

Here, the explanation is made by taking, as an example, a case where the records of lap time and split time (recorded elapsed times) which are elapsed times measured by the stopwatch function are displayed in order at a predetermined time interval. Each of the recorded elapsed times is displayed by the small hour hand 65, the small minute hand 64 and the second hand 61.

Figure 5:
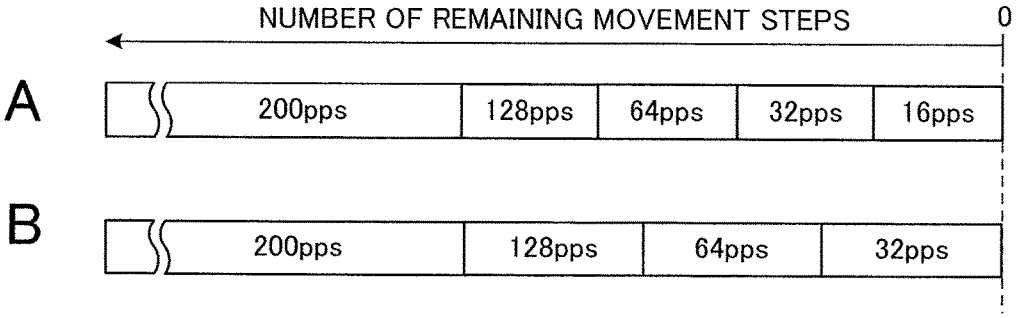
FIG. 5 is a view showing fast forward operation patterns by a second hand, a small hour hand and a small minute hand of an analog electronic timepiece in a second embodiment.

FIG. 5 is a view showing fast forward operation patterns by the hands 63 to 65 of the analog electronic timepiece 1 in the embodiment.

Here, the fast forward operation of the small minute hand 64 and the small hour hand 65 is normally performed by a pattern A shown in FIG. 5. If the fast forward time by the pattern A is not equal to or less than the upper limit time, the fast forward operation is performed by the pattern B shown in FIG. 5.

On the other hand, the fast forward operation of second hand 61 is performed by the patterns A and B shown in FIG. 2.

The fast forwarding of second hand 61 to the target position may be performed independently from the fast forwarding of the small minute hand 64 and the small hour hand 65 to the target positions.

As described above, the small minute hand 64 rotates 2 degrees per step. That is, the distance which the tip of the small minute hand 64 moves by one rotation is approximately ⅓ the distance which the tip of the small minute hand 64 moves in the analog electronic timepiece 1 in the first embodiment. When the movement distance per rotation is smaller in such way, a discrete operation is not noticeable even when the fast forward operation is performed at a low speed. If the display interval of each recorded time can be set to be wider than the measurement interval of sensor measurement, the upper limit time of fast forwarding can also be set to be longer than that of the first embodiment. On the other hand, the second hand 61 rotates 6 degrees per step and has a length which is twice or more the small minute hand 64. Thus, the second hand 61 has a larger movement distance for one rotation than that of small minute hand 64. Accordingly, regardless of the setting of display interval, similarly to the analog electronic timepiece 1 in the first embodiment, fast forward operation at a speed less than 32 pps is not performed.

In such way, the deceleration pattern can be switched according to the display contents not only according to the relationship between the required time of fast forwarding and the display switching interval (for example, measurement interval in the first embodiment).

Figure 6:
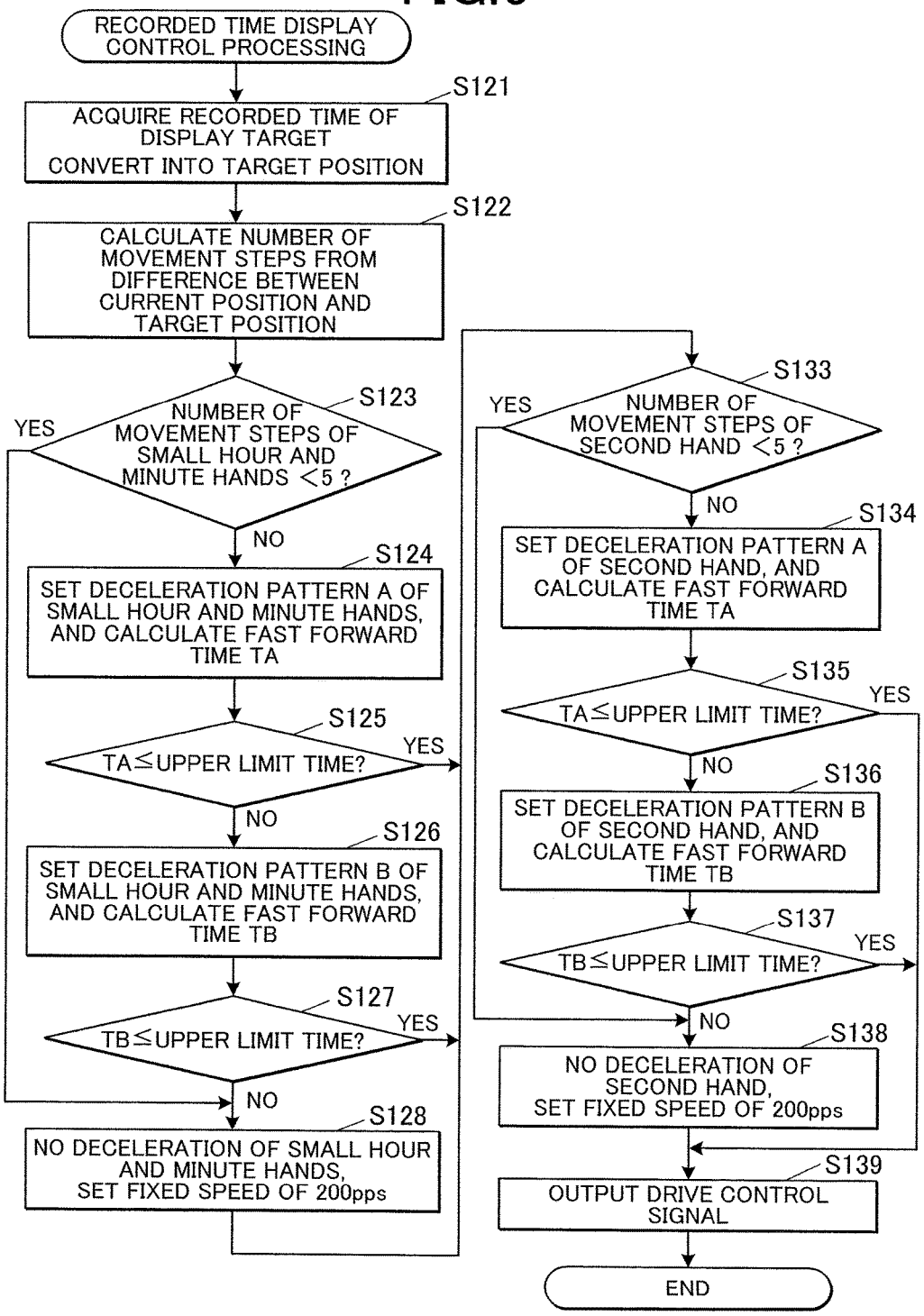
FIG. 6 is a flowchart showing a control procedure of recorded time display control processing executed by the analog electronic timepiece in the second embodiment.

FIG. 6 is a flowchart showing a control procedure by the CPU 41 of recorded time display control processing executed by the analog electronic timepiece 1 in the embodiment.

The recorded time display control processing is invoked at a predetermined time interval and executed until the display of all the recorded times is ended in a case where the mode shifts to the display mode of recorded time by a predetermined input operation to the operation section 47 by a user.

When the recorded time display control processing is started, the CPU 41 obtains recorded time which is a display target and converts the obtained time into a target position (step S121). The CPU 41 calculates the number of movement steps from the difference between the current position and the target position for each of the second hand 61, small minute hand 64 and small hour hand 65 (step S122).

The CPU 41 determines whether the number of movement steps of each of the small minute hand 64 and small hour hand 65 is less than 5 steps (step S123). If it is determined that the number of movement steps is less than 5 steps (step S123: YES), the processing of CPU 41 proceeds to step S128. If it is not determined that the number of movement steps is less than 5 steps (step S123: NO), the CPU 41 sets the pattern A in FIG. 5 as the fast forward operation of the small minute hand 64 and the small hour hand 65, and calculates the fast forward required time TA in the pattern A (step S124).

The CPU 41 determines whether or not the fast forward required time TA is equal to or less than the fast forward upper limit time (step S125). If it is determined that the fast forward required time TA is equal to or less than the fast forward upper limit time (step S125: YES), the processing of CPU 41 proceeds to step S133. If it is not determined that the fast forward required time TA is equal to or less than the fast forward upper limit time (step S125: NO) the CPU 41 sets the pattern B in FIG. 5 as the fast forward operation of the small minute hand 64 and small hour hand 65, and calculates the fast forward required time TB in the pattern B (step S126).

The CPU 41 determines whether or not the fast forward required time TB is equal to or less than the fast forward upper limit time (step S127). If it is determined that the fast forward required time TB is equal to or less than the fast forward upper limit time (step S127: YES), the processing of CPU 41 proceeds to step S133. If it is not determined that the fast forward required time TA is equal to or less than the fast forward upper limit time (step S127: NO), the processing of CPU 41 proceeds to step S128.

When the processing proceeds from steps S123 and S127 to step S128, the CPU 41 does not apply the pattern of performing deceleration when fast forwarding the small minute hand 64 and small hour hand 65, and sets the fast forwarding at the fixed speed of 200 pps (step S128). Then, the processing of CPU 41 proceeds to step S133.

When the processing proceeds from steps S125, S127 and S128 to step S133, the CPU 41 determines whether the number of movement steps of secondhand 61 is less than 5 steps (step S133). If it is determined that the number of movement steps of second hand 61 is less than 5 steps (step S133: YES), the processing of CPU 41 proceeds to step S138. If it is not determined that the number of movement steps of second hand 61 is less than 5 steps (step S133: NO), the CPU 41 sets the pattern A in FIG. 2 as the fast forward operation of second hand 61, and calculates the fast forward required time TA of the pattern A (step S134).

The CPU 41 determines whether or not the fast forward required time TA is equal to or less than the fast forward upper limit time (step S135). If it is determined that the fast forward required time TA is equal to or less than the fast forward upper limit time (step S135: YES), the processing of CPU 41 proceeds to step S139. If it is not determined that the fast forward required time TA is equal to or less than the fast forward upper limit time (step S135: NO), the CPU 41 sets the pattern B in FIG. 2 as the fast forward operation of second hand 61, and calculates the fast forward required time TB of the pattern B (step S136).

The CPU 41 determines whether or not the fast forward required time TB is equal to or less than the fast forward upper limit time (step S137). If it is determined that the fast forward required time TB is equal to or less than the fast forward upper limit time (step S137: YES), the processing of CPU 41 proceeds to step S139. IF it is not determined that the fast forward required time TB is equal to or less than the fast forward upper limit time (step S137: NO), the processing of CPU 41 proceeds to step S138.

When the processing proceeds from steps S133 and S137 to step S138, the CPU 41 does not apply the operation pattern performing deceleration when fast forwarding the second hand 61, and sets the fast forwarding at the fixed speed of 200 pps (step S138). Then, the processing of CPU 41 proceeds to step S139.

The CPU 41 outputs a drive control signal for fast forwarding each of the second hand 61, small minute hand 64 and small hour hand 65 to the drive circuit 49. Then, the CPU 41 ends the recorded time display control processing.

As described above, in the analog electronic timepiece 1 in the second embodiment, the CPU 41 sets the predetermined number of steps according to the speed change operation and the predetermined number of steps of the movement speeds on the basis of the display contents by the hands 61 to 65.

By setting the speed change pattern which provides an image matching the display contents in such way, the fast forward operation of hands 61 to 65 can be diversified more effectively to let the user know the display contents sensuously.

The present invention is not limited to the above embodiments, and various changes can be made.

For example, the above embodiments have been described by taking, as an example, a case where the number of movement steps is determined in advance and the deceleration timing is set so as to stop the hand operation at the time when the movement of the determined number of movement steps is ended. However, the present invention can also be applied to an acceleration operation of a case where an input operation is performed to instruct continuous fast forward operation for which stop timing is not determined by the user. Also at the time of deceleration, the fast forwarding may be stopped with the deceleration operation when it is not necessary to stop immediately after the user's input of stop operation. In this case, it is desirable that the total number of movement steps during the deceleration operation is not excessively large (for example, ¼ rotation or less on the dial plate).

In the embodiments, the fast forward speed (movement speed) is changed in a stepwise manner at the timings which are determined as speed change patterns 421 in advance, and stored in the ROM 42. However, in a case where the fast forward speed can be changed more finely, only a function or the like representing the temporal change of fast forward speed may be defined to nearly continuously determine the time to the next hand operation according to the speed which is obtained from the function for the elapsed time according to the speed change operation.

In the embodiments, the speed change operation is not performed in a case where the number of movement steps is within 5 steps. However, the speed change operation may be always performed and the above number of steps may be changeable to other than 5 steps. For example, the reference number of steps for not performing the speed change operation may be differentiated between the fast forwarding when displaying measurement data according to the analog electronic timepiece 1 in the first embodiment and the fast forwarding when displaying a history of measurement time according to the analog electronic timepiece 1 in the second embodiment.

In the embodiments, the fast forward speed is limited for the low speed part within a range of making the hand operation look smooth. However, the present invention is not limited to this.

The other details such as specific configurations and numerical values shown in the embodiments can be appropriately changed within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2015-181515 filed on Sep. 15, 2015 including description, claims, drawings, and abstract are incorporated herein by reference in its entirety.

What is claimed is:

1. An analog electronic timepiece, comprising:

a hand which is provided to be rotatable; and a processor which makes the hand perform at least one of an acceleration operation and a deceleration operation as a speed change operation when the hand is made to perform a fast forward movement, the acceleration operation being an operation of gradually increasing a fast forward speed of the hand from a stopped state when the fast forward movement is started, and the deceleration operation being an operation of gradually decreasing the fast forward speed until the hand comes into the stopped state when the fast forward movement is ended;

wherein, when a target movement amount of the hand in the fast forward movement is determined, the processor sets a speed change start movement amount and a speed change end movement amount in the fast forward movement for the target movement amount based on the target movement amount, the speed change start movement amount being a movement amount of the hand at a timing when the speed change operation is started, and the speed change end movement amount being a movement amount of the hand at a timing when the speed change operation is ended, and wherein, when the processor changes the fast forward speed between a predetermined number of two or more movement speeds in a stepwise manner in the speed change operation and makes the hand perform the fast forward movement at a predetermined interval, the processor sets the predetermined number and the movement speeds so that the fast forward movement is ended within an upper limit fast forward time which is less than the predetermined interval.

2. The analog electronic timepiece according to claim 1, further comprising a memory in which a plurality of types of speed change patterns are stored, each of the speed change patterns associating a plurality of speed change timings in the speed change operation with respective movement speeds after the speed change timings, wherein the processor selects one of the speed change patterns based on the upper limit fast forward time and a required time of the fast forward movement including the speed change operation by each of the plurality of types of speed change patterns, and the processor makes the hand perform the fast forward movement according to the selected speed change pattern.

3. The analog electronic timepiece according to claim 2, wherein, when the required time of the fast forward movement according to the speed change pattern is shorter than a time required for the speed change operation, the processor makes the hand perform an operation for an amount of the required time, the operation being a low speed part of the speed change operation according to the speed change pattern.

4. The analog electronic timepiece according to claim 3, wherein the processor sets the predetermined number and the movement speeds based on a display content by the hand.

5. The analog electronic timepiece according to claim 3, further comprising a sensor which measures a predetermined physical quantity, wherein the processor obtains a measurement result by the sensor at the predetermined interval, and determines a fast forward destination of the hand based on the obtained measurement result.

6. The analog electronic timepiece according to claim 3, wherein the processor determines whether to perform the speed change operation according to the target movement amount.

7. The analog electronic timepiece according to claim 2, wherein the processor sets the predetermined number and the movement speeds based on a display content by the hand.

8. The analog electronic timepiece according to claim 2, further comprising a sensor which measures a predetermined physical quantity, wherein the processor obtains a measurement result by the sensor at the predetermined interval, and determines a fast forward destination of the hand based on the obtained measurement result.

9. The analog electronic timepiece according to claim 2, wherein the processor determines whether to perform the speed change operation according to the target movement amount.

10. The analog electronic timepiece according to claim 1, wherein the processor sets the predetermined number and the movement speeds based on a display content by the hand.

11. The analog electronic timepiece according to claim 10, further comprising a sensor which measures a predetermined physical quantity, wherein the processor obtains a measurement result by the sensor at the predetermined interval, and determines a fast forward destination of the hand based on the obtained measurement result.

12. The analog electronic timepiece according to claim 1, further comprising a sensor which measures a predetermined physical quantity, wherein the processor obtains a measurement result by the sensor at the predetermined interval, and determines a fast forward destination of the hand based on the obtained measurement result.

13. The analog electronic timepiece according to claim 1, wherein the processor determines whether to perform the speed change operation according to the target movement amount.

14. An analog electronic timepiece, comprising:

a hand which is provided to be rotatable;

a processor which makes the hand perform at least one of an acceleration operation and a deceleration operation as a speed change operation when the hand is made to perform a fast forward movement, the acceleration operation being an operation of gradually increasing a fast forward speed of the hand from a stopped state when the fast forward movement is started, and the deceleration operation being an operation of gradually decreasing the fast forward speed until the hand comes into the stopped state when the fast forward movement is ended; and a hand driver which makes the hand perform a step operation by a predetermined angle, wherein, when a target movement amount of the hand in the fast forward movement is determined, the processor sets a speed change start movement amount and a speed change end movement amount in the fast forward movement for the target movement amount based on the target movement amount, the speed change start movement amount being a movement amount of the hand at a timing when the speed change operation is started, and the speed change end movement amount being a movement amount of the hand at a timing when the speed change operation is ended, and wherein a lowest value among a predetermined number of two or more movement speeds in the speed change operation is determined based on at least one of the predetermined angle and a length of the hand.

15. A hand drive control device, comprising:

a driver which rotates a hand; and a processor which makes the driver perform at least one of an acceleration operation and a deceleration operation as a speed change operation when the driver performs a fast forward movement of the hand, the acceleration operation being an operation of gradually increasing a fast forward speed of the hand from a stopped state when the fast forward movement is started, and the deceleration operation being an operation of gradually decreasing the fast forward speed until the hand comes into the stopped state when the fast forward movement is ended, wherein, when a target movement amount of the hand in the fast forward movement is determined, the processor sets a speed change start movement amount and a speed change end movement amount in the fast forward movement for the target movement amount based on the target movement amount, the speed change start movement amount being a movement amount of the hand at a timing when the speed change operation is started, and the speed change end movement amount being a movement amount of the hand at a timing when the speed change operation is ended, and wherein, when the processor changes the fast forward speed between a predetermined number of two or more movement speeds in a stepwise manner in the speed change operation and makes the driver perform the fast forward movement of the hand at a predetermined interval, the processor sets the predetermined number and the movement speeds so that the fast forward movement is ended within an upper limit fast forward time which is less than the predetermined interval.

16. A hand drive control device, comprising:

a driver which rotates a hand; and a processor which makes the driver perform at least one of an acceleration operation and a deceleration operation as a speed change operation when the driver performs a fast forward movement of the hand, the acceleration operation being an operation of gradually increasing a fast forward speed of the hand from a stopped state when the fast forward movement is started, and the deceleration operation being an operation of gradually decreasing the fast forward speed until the hand comes into the stopped state when the fast forward movement is ended, wherein the driver makes the hand perform a step operation by a predetermined angle, and wherein a lowest value among a predetermined number of two or more movement speeds in the speed change operation is determined based on at least one of the predetermined angle and a length of the hand.

* * * * *